US006000358A

United States Patent [19]

Dickenson

[11] Patent Number: 6,000,358

[45] Date of Patent: Dec. 14, 1999

[54] BEACHING BOW FOR FLOATING PLATFORMS AND WATERCRAFT

[76] Inventor: Robert P. Dickenson, 211 Nahant Rd., Nahant, Mass. 01908

[21] Appl. No.: 09/079,058

[22] Filed: May 14, 1998

[51] Int. Cl.[6] ..... B60P 3/10

[52] U.S. Cl. ..... 114/344; 14/2.6; 14/27

[58] Field of Search ..... 14/2.6, 27; 440/12.5; 114/61, 123, 344

[56] References Cited

U.S. PATENT DOCUMENTS

| | | | |
|---|---|---|---|
| 3,581,701 | 6/1971 | Gehlen | 440/12.5 |
| 4,621,385 | 11/1986 | Gillois | 14/27 |

OTHER PUBLICATIONS

SW1 Lang, "Articulated Beach Ramp" Beeline, published by Amphibious Construction Battalion ONE, U.S. Navy, Fall 1991 pp. 10–11.

Future Causeway System, U.S. Navy, http://www.nfesc.navy.mil/amphib/causeway/future.html, no date.

*Primary Examiner*—Stephen Avila

*Attorney, Agent, or Firm*—Dike, Bronstein, Roberts & Cushman, LLP; David G. Conlin; Lisa Swiszcz Hazzard

[57] ABSTRACT

A beaching bow for use on watercraft, water vessels and landing craft. The beaching bow has a substantially wedge shape, and is connected to the watercraft by a flexible hinge joint near a top surface. The beaching bow includes a center of buoyancy forward to the flexible hinge joint, allowing the beaching bow to float upward and assume a proper angle depending on the floating displacement of the watercraft, and the hydrodynamic effect when the watercraft moves through the water. Upon reaching a beach or other landing surface, the beaching bow rotates down to securely interface with the beach, and allow the loading and unloading of equipment, vehicles and personnel from the watercraft.

15 Claims, 4 Drawing Sheets

BEACHING BOW FOR FLOATING PLATFORMS AND WATERCRAFT

FIELD OF INVENTION

This invention relates to beaching bows for floating platforms, such as floating causeways, barges, floating temporary bridges and the like, which bows provide ramps for vehicles, personnel and material to be downloaded from the floating platform onto the beach or shore. More particularly, the invention relates to beaching bows which enhance the movement of such platforms through the water, and also enhance the stability and operation of the downloading ramp when such vessels are landed.

BACKGROUND

Floating causeways have previously been designed and built which provide a downloading ramp at the forward end of the structure, which, when the structure is driven up upon the beach or shore, provide a ramp extending downwardly from the front of the vessel to the beach. Using such ramps, the off-loading of vehicles, personnel and other material is greatly facilitated. However, such structures have met with substantial problems in the past.

For example, the down ramp extending from the forward end of such floating causeways adversely impacts and limits the forward motion of the craft, especially in rough seas. Even in calm seas, the down ramp tends to pull the front end of the structure into the water, limiting the speed of the craft, causing drag, and presenting a sharp angle to the beach or shoreline when the beaching bow is landed. In rough seas, the problems are exacerbated, as the submerged beaching bow causes the waves to flow up and over the front of the structure, potentially causing further vessel control problems, as well as potentially damaging vehicles, supplies and personnel being carried by such causeways.

Other vessels, such as landing craft, have employed powered disembarking platforms which must be raised and lowered either manually or with sophisticated power devices, when the vessel is beached. When such platforms are raised, they can shift the center of gravity of the vessel, creating a top heavy vessel which is less stable. When lowered, they cause the bow to submerge, which greatly decreases speed, and increases the difficulty of making headway and maintaining direction. Again, such problems are exacerbated by rough seas, which greatly increase the drag and buffeting of any watercraft.

For example, the United States Navy employs a Navy Lightered (NL) causeway system, including a proposed Amphibious Cargo Beaching Lighter (ACBL). The ACBL uses modules which are 40 feet long, 24 feet wide, and 8 feet high. The modules are connected together using a rigid pin and guillotine connector. A ramp module is connected to the fore end. However, the ramp module is prone to the problems discussed hereinabove, including submerging, instability and poor beaching interface.

When the watercraft reaches land, inclined surfaces common to beaches makes setting up a disembarking and loading surface more difficult. For cargo, personnel and vehicles to be easily loaded and unloaded, a smooth surface without gaps or drops is required.

SUMMARY

The beaching bow component of the present invention is a design for the beaching end of a floating causeway's hull which provides an embarkation and debarkation interface with a beach or other surface, and provides exceptional hydrodynamic performance when the platform is moving through the water with the beaching bow component at its forward end. The beaching bow component provides a ramp-like structure from the floating platform to the beach for transfer operations such as the loading or discharge of cargo, personnel, or vehicles. Such vehicles include cars, trucks, jeeps, tanks and air cushion vehicles. When the floating platform is moving through the water with the beaching bow component at the forward end, whether self-propelled or towed, the beaching bow component assumes an attitude which enhances the platform's hydrodynamic qualities compared to those of a fixed ramp-like structure at the bow.

The attitude of the beaching bow when moving through the water is governed by static buoyancy and by hydrodynamic forces. Upon contact with a beach (or other) gradient, the beaching bow assumes a ramp-like attitude, with it's bottom surface parallel to and in contact with the beach. This transition to the beached attitude is caused by physical contact of the trailing edge of the beaching bow with the beach. The beaching bow is physically connected to the floating platform through an articulated connection which constrains the beaching bow but allows it to change its attitude.

Features of the present invention include greatly decreased drag during forward motion in both calm and rough waters. This in turn allows reduced power requirements for driving or towing vessels equipped with the beaching bow. Higher speeds are also achieved.

The present invention also improves trim and increases stability. A smoother ride results.

Another feature of the present invention is that complicated mechanisms to raise and lower ramps are no longer necessary. The beaching bow self adjusts for whatever weight load, and does not need to be raised during movement and lowered upon reaching land. Further, since a raised ramp is not blocking the view off the front of the watercraft, visibility is greatly improved.

The bow component for a watercraft comprises a substantially wedge shape, including a fore end and aft end, with the fore end having a height thickness less than a height thickness of the aft end. A pivot mechanism is proximate the aft end, and is coupled to an end of the watercraft, thereby allowing the bow component to rotate up and down. The bow component includes a center of buoyancy located at a point between the pivot mechanism and the fore end, whereby the center of buoyancy causes the fore end to remain above a water surface, both while at rest and while underway.

When the bow component contacts a land surface, the pivot mechanism allows the bow component to rotate down and contact with the land surface. The bow component provides a surface for loading and unloading from the watercraft to the land surface. The bow component includes a center of gravity wherein it will rotate down when in contact with the land surface. Alternatively, a trailing edge of the bow component's contact with a land surface contributes to the downward rotation. This contact provides a moment countering that of the buoyancy.

In one embodiment, the pivot mechanism is proximate a top surface of the bow component aft end.

The beaching bow component comprises a substantially wedge shape, including a bottom surface being substantially horizontal, and including a length and width. A top surface of the beaching bow component has a length shorter than the length of said bottom surface, and a width approximate the width of the bottom surface. An aft end surface has a length shorter than the top surface, and a width approximate the width of the top surface. A flexible pivot mechanism proximate the aft end surface, is coupled to an end of the watercraft.

The bow component includes a center of buoyancy at a point between a top edge formed by the first and aft end surfaces, and a front edge formed by the top surface and the bottom surface. The flexible pivot mechanism is proximate the top edge formed by said first and aft end surfaces. An angle formed by an edge where the bottom surface and aft end surface meet is less than 90 degrees. In an alternative embodiment, the aft end surface of the bow component includes a concave curve, and the end of the watercraft includes a corresponding convex curve, whereby the concave curved aft end surface slides and rotates along the convex curved side of the watercraft.

BRIEF DESCRIPTION OF THE DRAWINGS

The foregoing and other features and advantages of the present invention will be more fully understood from the following detailed description of illustrative embodiments, taken in conjunction with the accompanying drawing in which.

DETAILED DESCRIPTION

Figure 1:
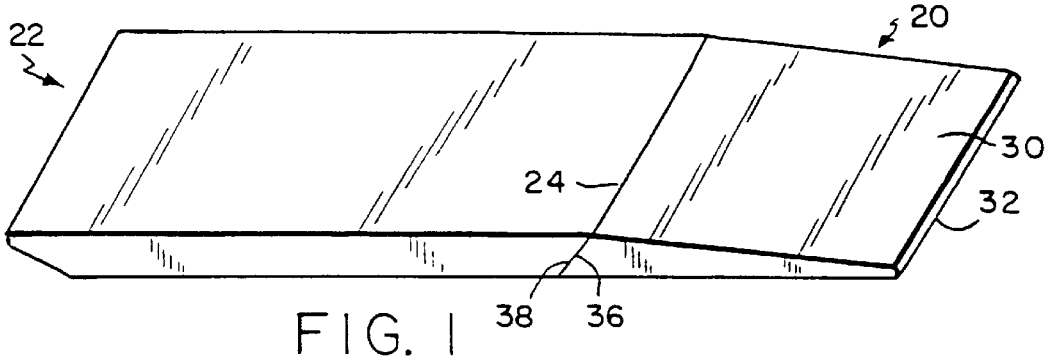
FIG. 1 is an overview of a beaching bow component according to the present invention.

FIG. 1 provides an overview of one embodiment of a beaching bow component 20 proximate to a barge-like floating platform 22 according to the present invention. The beaching bow component 20 is generally wedge shaped, with a bottom surface 32, a top surface 30 and an aft end surface 36. In use, the aft end surface 36 is proximate an end surface 38 of the floating platform 22. The aft end surface 36 is angled aft from vertical, and matches a similar angle to end surface 38 of the floating platform 22. An articulated joint 24, such as a hinge joint or pivot mechanism, connects the beaching bow component 20 to the floating platform 22. The articulated joint 24 is proximate near the top of the aft end surface 36, and fore end surface 38 of the floating platform 22.

In FIG. 1, the assembly 20, 22 and 24 is shown as it would be when resting on a flat surface. The downward slope of the beaching bow component deck 30 provides the transition for moving cargo or equipment between a beach and the floating platform 22.

Figure 2:
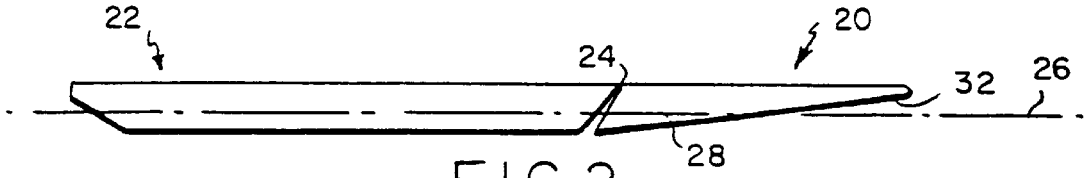
FIG. 2 illustrates a beaching bow component and watercraft in calm water.

The above-described embodiment of the beaching bow component 20 and floating platform 22 afloat in calm water 26 is shown in FIG. 2. The beaching bow component 20 has swung upward due to the hydrostatic force of the displaced water 26 that equals the weight of the beaching bow component 20. Further, center of buoyancy 28 (the geometric center of the submerged volume of the beaching bow) of the beaching bow component 20 is forward of the articulated joint 24.

The amount of rotation of the beaching bow component 20 upwards depends on several factors. Among these are the geometry of the beaching bow component 20, the location of the articulated joint 24 connecting the beaching bow component 20 to a floating platform 22, the weight distribution of the beaching bow component 20, and the loading of the floating platform 22 or other floating vessel. A decrease in the vessel freeboard forward of the floating platform 22 (i.e., it is lower in the water 26) will increase the amount of rotation upward of the beaching bow component 20. Thus, as the floating platform 22 is loaded with more cargo, ballast, or other weight, the forward end of the beaching bow component 20 will become higher. This is in contrast to a fixed ramp-like bow which will become lower in the water as the floating platform 22 is loaded.

Figure 3:
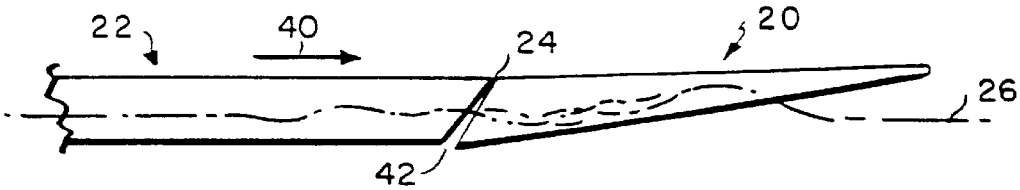
FIG. 3 illustrates a beaching bow component and watercraft making headway.

As the floating platform or vessel 22 with the beaching bow component 20 moves forward through the water 26, as shown by arrow 40 FIG. 3, hydrodynamic pressure under the beaching bow component 20 causes it to rotate further upward so that its forward end stays above the level of the water 26, thus preventing any dipping of the bow under the water 26. The articulated joint 24 is located proximate the top surface of the beaching bow component 20 and floating platform 22, thereby allowing the beaching bow component 20 to rotate upwards by increasing the gap 42 between aft end surface 36 of the beaching bow component 20 and end surface 38 of the floating platform 22.

Figure 4A:
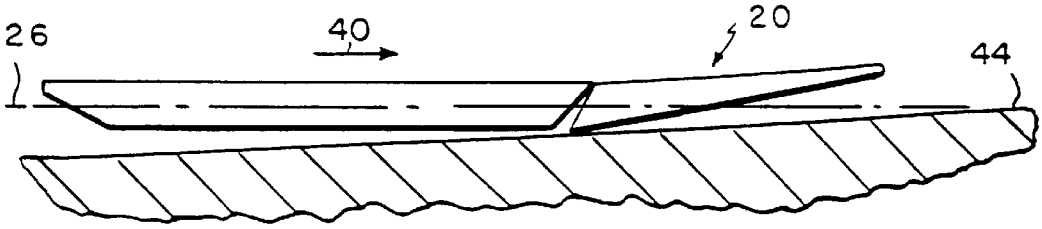
FIG. 4A illustrates a beaching bow component and watercraft making contact with beach.

As the floating platform or vessel 22 with the beaching bow component 20 approaches a beach 44 FIG. 4A, or other inclined surface, the trailing edge of the bottom surface 32, proximate the aft end surface 36, will be the first part of the beaching bow component 20 to make contact. In the present embodiment, the beaching bow component 20 includes design parameters for beach incline. These incline parameters can be adjusted, including dynamically by adjusting the floatation parameters of the beaching bow component 20.

Figure 4B:
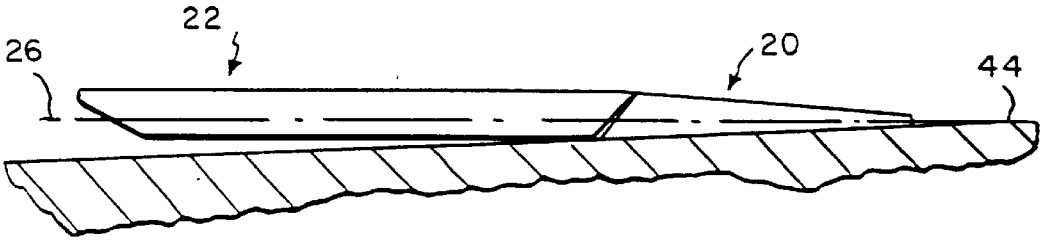
FIG. 4B illustrates a beaching bow component and watercraft on the beach

As contact is made with the beach 44 FIG. 4B, the beaching bow component 20 rotates downward so that its bottom surface 32 aligns with the inclined surface of the beach 44. In this attitude, a smooth transition surface is provided between the top surface of the floating platform 22 and the top surface 30 of the beaching bow component 20, to enable cargo or equipment to be moved to or from the beach 26 or other inclined surface (not shown). The top surface 30 of the beaching bow component 20 may be specially constructed for loading and unloading of supplies, including reinforcement for the weight of heavy vehicles or cargo, friction increasing surface preparation to prevent slipping, and guides to keep the wheels of vehicles properly aligned.

The articulated joint 24 is any type of pivotal system which allows the beaching bow component 20 to freely rotate up and down, such as a hinge. The articulated joint 24 is designed with the requirements of the beaching bow component 20 and vessel 22, such as structural strength to support weight both in the water and on land, including the weight of vehicles as they drive over the articulated joint 24.

Figure 5:
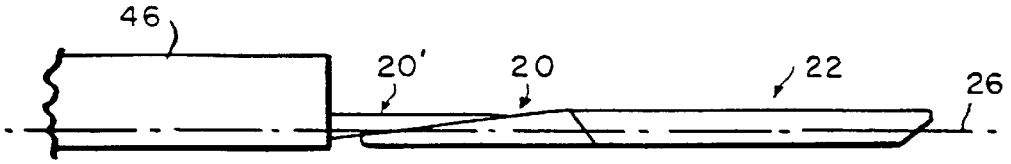
FIG. 5 illustrates a landing craft interfacing with a beaching bow component and watercraft.

The beaching bow component 20 is also useful as an inclined landing surface for other vessels 46 FIG. 5 with beaching bow components 20' or other ramp structures designed to allow the transfer of cargo. For example, a landing craft type vessel landing at a vessel equipped with a beaching bow could interface with a beaching bow component 20 and floating platform 22 either in water or located on a beach or other surface. Alternatively, the landing craft 46 could be equipped with a traditional landing craft type ramp which is raised and lowered mechanically.

In all situations of interfacing with another object, whether it be a fixed object or floating, the ability of the beaching bow component 20 to conform to the gradient of that surface provides an improved interface compared to a fixed ramp structure. When moving through the water, the beaching bow component 20 prevents submergence of the ramp and will reduce the propulsive power required to attain a desired speed or make it possible to attain a desired speed without submergence of the bow.

Figure 6:
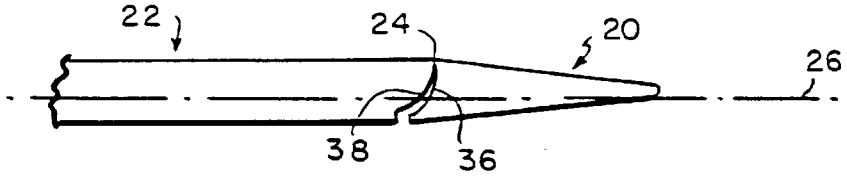
FIG. 6 illustrates an alternative joint geometry for a bow component.

In a second embodiment as shown in FIG. 6, the configuration of the aft end surface 36 and end surface 38 forming the articulated joint 24 between the beaching bow component 20 and the floating platform 22 vessel need not be flat. Other geometries may be used to alter the weight distribution and hydrostatic and hydrodynamic characteristics of the beaching bow component 20. For examples, as shown in FIG. 6, a substantially cylindrical-shaped articulated joint 24 is created, by imparting a generally concave shape to the aft end surface 36, and a corresponding convex shape to the end 36 of the vessel 22. This results in a beaching bow component 20 having a center of buoyancy which is further forward. Further, the bottom portion of aft end surface 36 is better positioned to make contact with a land surface and help rotate the beaching bow component 20 down to make contact with land (not shown).

Figure 7:
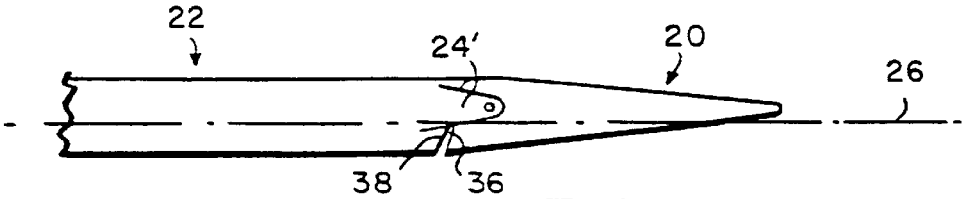
FIG. 7 illustrates an alternative articulated joint for a bow component.

FIG. 7 illustrates an alternative articulated joint 24', which results in a pivot point (moment) further forward from the aft end surface 36. In the embodiment shown in FIG. 7, the aft end surface 36 has a generally convex shape, and the end surface 36 of the vessel 22 has a corresponding concave shape.

Figure 8:
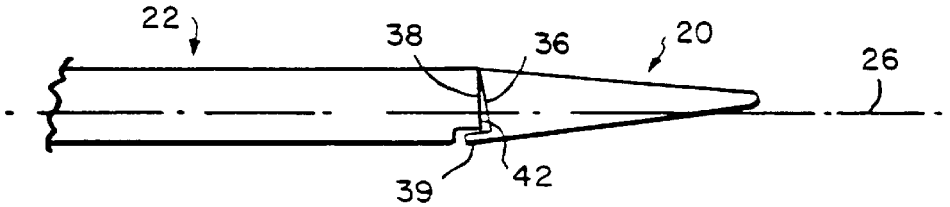
FIG. 8 illustrates yet another alternative joint geometry for a bow component.

FIG. 8 illustrates another surface geometry for the aft end surface 36 and end surface 38. Here, the aft end surface 36 includes a bottom extension 39, which extends partially under the vessel 22. This bottom extension helps reduce turbulence by partially covering the opening 42 while the watercraft is making headway. Further, as described in reference to FIG. 6, the bottom extension, upon making contact with land, serves to help rotate the beaching bow component 20 down to make full contact the land.

Calculations for determining the floatation characteristics of an illustrative embodiment of the present invention will now be presented. The static afloat attitude of the beaching bow component 20 can be estimated using standard naval architectural calculations. These calculations may be influenced by the hydrostatic characteristics and the range of operational displacements of the vessel to which the beaching bow component 20 is to be applied.

For this example, a beaching bow component 20 is to be applied to a barge of dimensions 300 feet long, 30 feet wide, and 8 feet deep. The weight of the barge empty is 515 long tons (1 long ton=2,240 lb.), and it can carry up to 1,200 long tons of cargo. Ignoring the hydrostatic effects of any raked ends of the barge, it should float at a draft of about 2 feet in this condition:

$$(515\ \text{LT}\}\times(2{,}240\ \text{lb./LT})/(64\ \text{lb/cu.ft. salt water})/(300\ \text{ft.})/(30\ \text{ft).}=2\ \text{ft.} \quad \text{(Eq. 1)}$$

At full load, the draft would be approximately 6.67 feet:

$$(515\ \text{LT}+1{,}200\ \text{LT})\times(2{,}240\ \text{lb/LT})/(64\ \text{lb/cu.ft. salt water})/(300\ \text{ft.})/(30\ \text{ft.})=6.67\ \text{ft.} \quad \text{(Eq. 2)}$$

Figure 9:
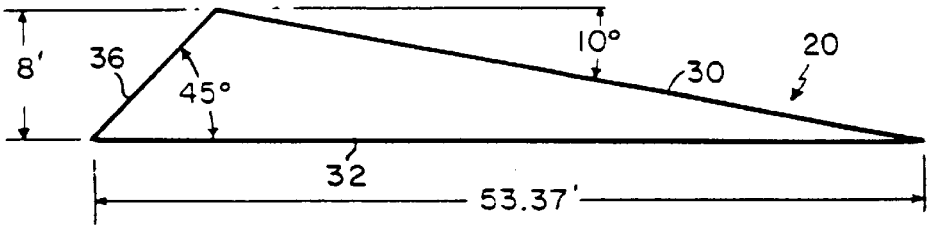
FIG. 9 illustrates geometry of an illustrative embodiment of a beaching bow component according to the present invention.

An assumed bow configuration 20 is then created as shown in FIG. 9. The corners of the bow geometry are left with a fine point in order to simplify the calculations.

An initial estimate of the beaching bow component's weight is calculated. Assume hull plating is ¼" thick steel plate. The surface area of the three-dimensional wedge shape is determined, and then the weight is determined. Surface area:

$$(53.37\times30)+(53.37\times8/2)\times2+(8/\text{Cos}\ (45°)\times30)+(8/\text{Sin}(10°)\times30)=1,601.1+427+339.4+1382.1=3{,}749.6\ \text{sq. ft.} \quad \text{(Eq. 3)}$$

$$\text{Shell plate weight}=3{,}750\ \text{sq. ft.}\times10.4\ \text{lb/sq.ft.}=39{,}000\ \text{lbs.} \quad \text{(Eq. 4)}$$

For this example, the internal structure weight of the beaching bow component 20 is estimated to be equal to the shell plate weight, however variations in the internal weight are possible and do not affect the workings of the present invention. Thus the total weight is estimated=78,000 lb.

Figure 10:
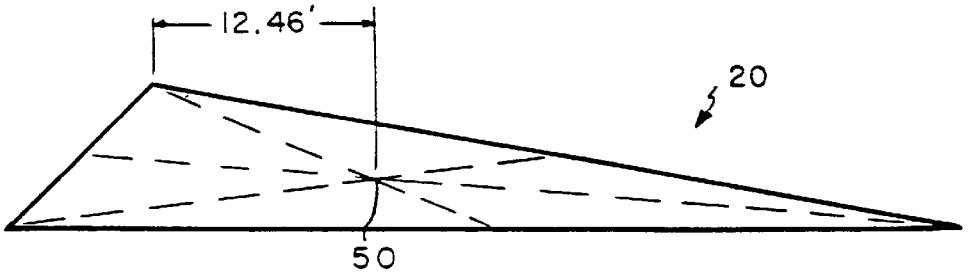
FIG. 10 illustrates determining an estimate of the center of gravity of the illustrative beaching bow component of FIG. 9.

For this example, the center of gravity (CG) of the bow 20 is assumed to be at it's geometric center. Of course, the internal structure of the bow 20 will affect the center of gravity, and any internal structure (such as floatation tanks and structural reinforcement) is designed in deference to its effect on the center of gravity of the bow 20 The geometric center is at the point of intersection 50 FIG. 10 of the lines joining the three vertices with the midpoint of the opposite sides.

Next, the buoyancy of the bow 20 and the center of buoyancy is calculated for several positions of rotation. The initial calculation will be made with the point of the bow just at the waterline as follows:

Rotation=θ:

$$2\ \text{ft.}=\text{Sin}(\theta)\times8\ \text{ft./sin}(10°);\ \theta=2.49\ \text{degrees} \quad \text{(Eq. 5)}$$

Depth of trailing edge of bow below water:

$$\{[8\ \text{ft./cos}(45°)]\times\text{sin}\ (45°+\theta)\}-6\ \text{ft.}=2.34\ \text{ft.} \quad \text{(Eq. 6)}$$

Figure 11:
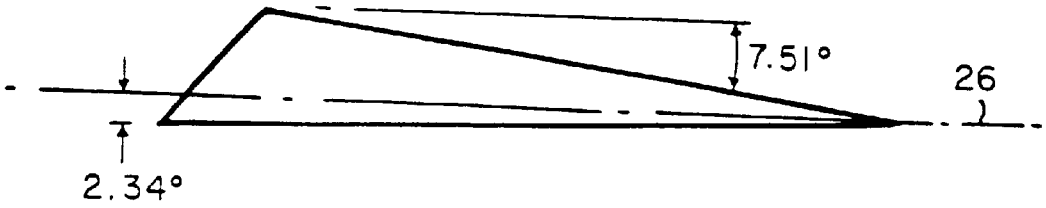
FIG. 11 illustrates determining dimensions of submerged area of the illustrative beaching bow component of FIG. 9.

Therefore the base length of the submerged triangle=53.37 ft, FIG. 11. The length of the aft end of the bow triangle is:

$$53.37\times\text{sin}\ (10°)/\text{sin}\ (125°)=11.31\ \text{ft.} \quad \text{(Eq. 7)}$$

The length of the above-water portion of this aft end is:

$$6\text{ ft.}/\cos(45°-2.49°)=8.14\text{ ft.} \quad \text{(Eq. 8)}$$

The altitude of the submerged triangle is:

$$(8\text{ ft.})\times(11.31\text{ ft}-8.14\text{ ft.})/11.31\text{ ft.}=2.24\text{ ft.} \quad \text{(Eq. 9)}$$

Therefore the submerged volume is:

$$30\text{ ft.}\times 53.37\text{ ft.}\times 2.24\text{ ft.}/2=1{,}793.2\text{ cu. ft.} \quad \text{(Eq. 10)}$$

and the displacement is:

$$1{,}793.2\text{ cu. ft.}\times 64\text{ lb/cu.ft. (salt water)}=114{,}765\text{ lb.} \quad \text{(Eq. 11)}$$

Figure 12:
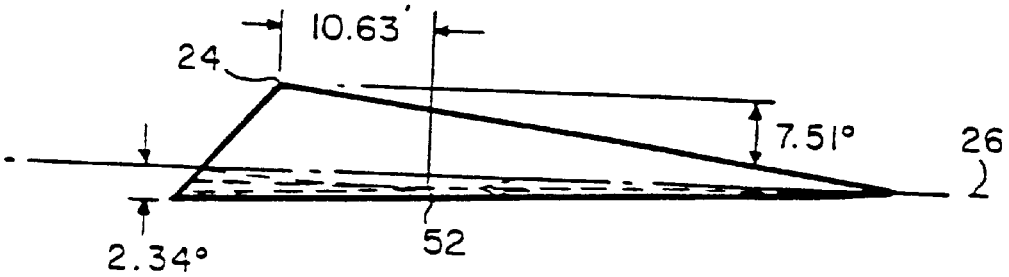
FIG. 12 illustrates determination of center of buoyancy of submerged volume as determined with reference to FIG. 11.

The center of buoyancy of this submerged volume is determined graphically to be 10.63 ft. forward of the articulated joint 24, as shown in FIG. 12.

By taking moments about the articulated joint 24, it can be determined which way the bow will rotate from this position to seek equilibrium:

$$\Sigma\text{Moments}=(78{,}000\text{ lb}\times 12.46\text{ ft.})-(114{,}765\text{ lb.}\times 10.63\text{ ft.})=-248{,}072\text{ lb-ft.} \quad \text{(Eq. 12)}$$

The negative sign of the unbalanced moment indicates that the bow will rotate counterclockwise as shown in FIG. 12 or upwards.

Figure 13:
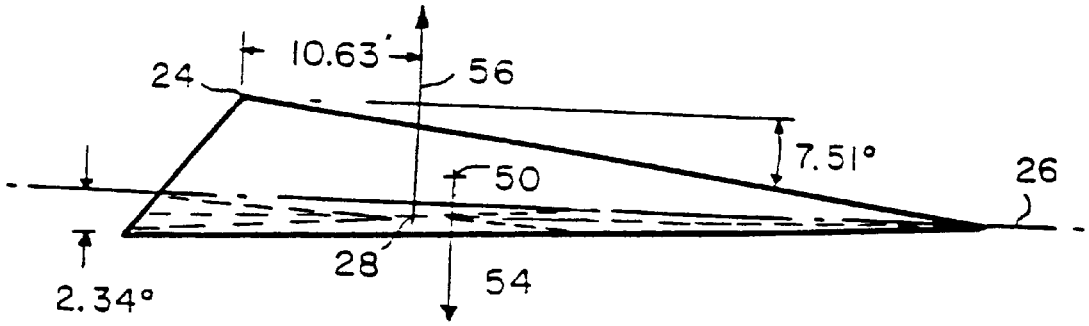
FIG. 13 illustrates the forces created by a center of buoyancy and center of gravity of the illustrative embodiment of FIG. 9.

FIG. 13 illustrates the two forces acting on the bow while at rest. The articulated joint 24 acts as the center of rotation. The center of buoyancy 28 exerts an upward force as shown by arrow 56. The center of gravity 50 exerts a downward force as shown by arrow 54. As described with reference to Equation 12, the bow will rotate around the pivot (articulated join 24) until it reaches an equilibrium position in the water 26. As described above, the center of buoyancy 28 and center of gravity 50 are designed and determined to achieve the maximum benefit of the present invention, including optimal positioning while under headway in the water 26 (with the leading edge of the beaching bow component 20 above water), and optimal contact with the land surface upon landing.

The remainder of the calculations to determine the equilibrium attitude of the bow is through iterations of this procedure. The bow will be imposing an upward load on the articulated joint 24, which will have some effect on the equilibrium position of the barge; but this effect is likely to be of second order. The moments for other assumed angles of rotation of the bow have been calculated and plotted as shown in FIG. 14A.

Figure 14A:
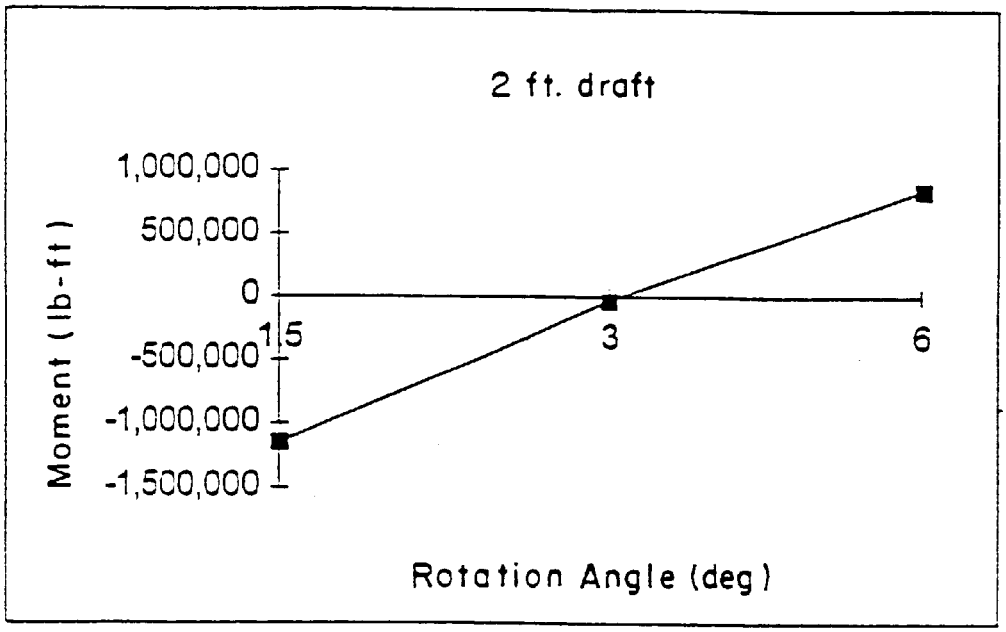
FIG. 14A graphically illustrates a plot of net moment on bow component about pivot point vs. rotation angle for 2 ft. draft.

It can be seen from FIG. 14A that the rotation angle will be just over 3° with the bow in static equilibrium for the assumed weight and center of gravity of this example embodiment of the beaching bow component 20. The bow emergence (BE) above the waterline for this static condition is calculated as follows:

$$\text{Length of bow deck}=53.37\text{ ft,}\times\sin(45°)/\sin(125°)=46.07\text{ ft.} \quad \text{(Eq. 13)}$$

$$\text{BE}-6\text{ ft.}=46.07\text{ ft.}\times\sin(7°)=5.61\text{ ft. BE}=0.39\text{ ft.} \quad \text{(Eq. 14)}$$

Figure 14B:
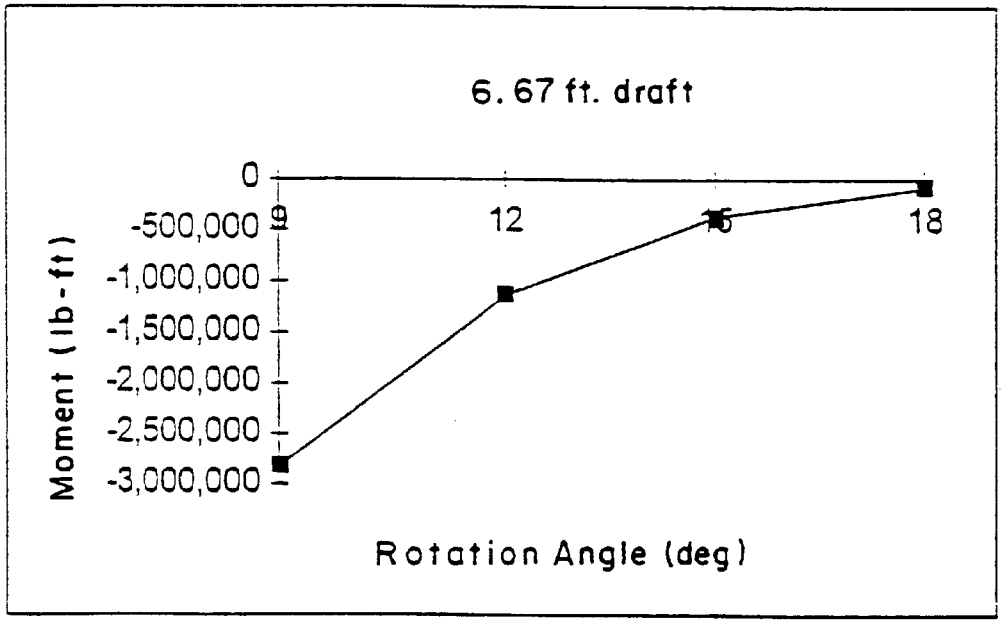
FIG. 14B graphically illustrates a plot of net moment on bow component about pivot point vs. rotation angle for 6.67 ft. draft.

Similar calculations are performed for the loaded condition in which the barge draft is 6.67 ft. The following plot of moments about the pivot point (FIG. 14B) shows the results of these calculations.

The predicted rotation angle for the beaching bow component 20 in static conditions is about 18°. The deck surface of the bow would be 8° above horizontal. The bow emergence above the waterline is 9.9 ft.

Adjustments to the static floatation properties of the beaching bow component 20 may be made at a preliminary point, or at a later juncture when more accurate estimates of weight distribution can be determined. Other factors to consider include the lift and drag on the bow due to dynamic phenomena to estimate the bow's attitude at designed speed. References for estimating buoyant and dynamic lift and drag are available such as "Hydrodynamic Design of Planing Hulls" by D. Savitsky, Stevens Institute of Technology, Dec. 1963, which is fully incorporated herein by reference.

Should alteration of the static characteristics be desired, there are several techniques of doing so. For example, changing the shape of the buoyant element including eliminating some buoyant volume by making portions of the buoyant volume open to the sea or the incorporation of ballast tanks. The weight distribution of the bow can also be changed by using fixed ballast. The location of the pivot point of articulated joint 24 can also be changed with appropriate geometric changes to allow a smooth transition from the cargo deck of the barge to the beaching bow component 20 deck for equipment and cargo. Further, the articulated joint 24 may include locking mechanisms to prevent movement and shifting while loading and unloading material, or during storage.

The beaching bow component 20 may also include damping mechanisms to minimize oscillations (both pitch and roll) occurring due to rough waters. General damping mechanisms, or mechanisms designed to eliminate only certain frequencies of oscillation are useful, and within the scope of the present invention. Such mechanisms include flume tanks, control fins, active trim systems etc. The articulated joint 24 may include active or passive damping mechanisms to prevent porpoising. The general shape of the beaching bow may also be altered for example to improve aerodynamics and hydrodynamics without departing from the scope of the invention.

In another embodiment of the present invention, beaching bow component 20 may rotate around articulated joint 24 so as to rest on top of vessel 22. This feature in effect folds the beaching bow component 20 and vessel 22 in half, for storage or ease of transportation while not in water.

As various changes could be made in the above constructions without departing from the scope of the invention, it should be understood that all matter contained in the above description or shown in the accompanying drawings shall be interpreted as illustrative and not in a limiting sense.

What is claimed is:

1. A bow component for a watercraft comprising:

a substantially wedge shape, including a fore end and aft end, said fore end having a height thickness less than a height thickness of said aft end; and a self-acting pivot mechanism proximate said aft end, and coupled to an end of said watercraft, said pivot mechanism automatically allowing said bow component to rotate up and down;

wherein said bow component includes a center of buoyancy located at a point between said pivot mechanism and said fore end, whereby said center of buoyancy causes said fore end to remain above a water surface.

2. The bow component of claim 1 wherein:

when said bow component contacts a land surface, said pivot mechanism automatically allows said bow component to rotate down and contact with said land surface.

3. The bow component of claim 2 wherein said bow component provides a surface for loading and unloading from said watercraft to said land surface when said bow component is in contact with said land surface.

4. The bow component of claim 2 wherein said bow component includes a center of gravity wherein said bow component will rotate down when in contact with said land surface.

5. The bow component of claim 2 wherein said bow component aft end contacts said end of said watercraft when said bow component is in contact with said land surface.

6. The bow component of claim 1 wherein said pivot mechanism is proximate a top surface of said bow component aft end.

7. The bow component of claim 1 wherein said bow component includes a width similar to a width of said watercraft.

8. The bow component of claim 1 wherein said bow component aft end includes a concave curve shape, and said end of said watercraft includes a corresponding convex curve shape, whereby said concave curved bow component aft end slides and rotates along said convex curved end of said watercraft.

9. The bow component of claim 1 wherein said bow component aft end includes an extension at a bottom surface, said extension extending partially under said watercraft.

10. A bow component for a watercraft comprising:

a substantially wedge shape, including a bottom surface, a top surface with a length shorter than a length of said bottom surface, and an aft end surface with a length shorter than said length of said top surface, whereby said aft end surface has a at least one of the following configurations: the aft end surface forms an angle with the bottom surface, the angle being less than 90 degrees; the aft end surface includes a concave curve; and the aft end surface includes a convex curve; and a pivot mechanism proximate said aft end surface, and coupled to an end of said watercraft;

wherein said bow component includes a center of buoyancy at a point between a top edge formed by said top surface and said aft end surface, and a front edge formed by said top surface and said bottom surface.

11. The bow component of claim 10 wherein said pivot mechanism is proximate said top edge formed by said top surface and said aft end surface.

12. The bow component of claim 10, wherein an angle of an edge formed by said bottom surface and said aft end surface is less than 90 degrees.

13. The bow component of claim 12 wherein said end of said watercraft is substantially a same length as said length of said aft end surface, and when said aft end surface is proximate said end of said watercraft, said bottom surface is substantially parallel with a bottom surface of said watercraft.

14. The bow component of claim 10 wherein said aft end surface includes a concave curve, and said end of said watercraft includes a corresponding convex curve, whereby said concave curved aft end surface slides and rotates along said convex curved side of said watercraft.

15. A bow component for a watercraft comprising:

a substantially wedge shape, including a fore end and aft end, said fore end having a height thickness less than a height thickness of said aft end; and a self-acting pivot mechanism proximate said aft end, and coupled to an end of said watercraft, said pivot mechanism automatically allowing said bow component to rotate up and down; and a means for maintaining said fore end of said bow component above a water surface while said bow component is supported by water, but automatically allowing said bow component to rotate down and contact land when said bow component is no longer supported by water.

* * * * *